US006425275B1

(12) United States Patent
Geurden

(10) Patent No.: US 6,425,275 B1
(45) Date of Patent: Jul. 30, 2002

(54) LOCKING DEVICE WITH A KEY-ACTIVATED CYLINDER CORE

(75) Inventor: Armin Geurden, Heiligenhaus (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 09/530,676

(22) PCT Filed: Nov. 2, 1998

(86) PCT No.: PCT/EP98/06924

§ 371 (c)(1),
(2), (4) Date: May 2, 2000

(87) PCT Pub. No.: WO99/24685

PCT Pub. Date: May 20, 1999

(30) Foreign Application Priority Data

Nov. 7, 1997 (DE) ..... 197 49 329

(51) Int. Cl.[7] ..... E05B 63/00
(52) U.S. Cl. ..... 70/422
(58) Field of Search ..... 70/422, 57, 492, 70/237

(56) References Cited

U.S. PATENT DOCUMENTS 5,070,716 A * 12/1991 Whorlow ..... 70/492
5,263,348 A * 11/1993 Wittwer ..... 70/379

FOREIGN PATENT DOCUMENTS

| | | |
|---|---|---|
| DE | 4122414 | 12/1992 |
| DE | 4410783 | 4/1995 |
| DE | 4408910 | 9/1995 |
| DE | 4410736 | 10/1995 |

* cited by examiner

*Primary Examiner*—Yonel Beaulieu
(74) *Attorney, Agent, or Firm*—Friedrich Kueffner

(57) ABSTRACT

A locking device with a key-actuated cylinder core has a cylinder guide rotationally supporting the cylinder core and stopping points for tumblers. One area of the cylinder guide is received axially fixed but rotatably in a housing, while the other area is surrounded by a sliding member non-rotatably but axially slidably supported on the cylinder guide. A turning member surrounds the sliding member and is rotatable relative to and synchronously axially movable with the sliding member. A spring acts axially on the turning member. An overload protection device has a control element arranged on the housing and a counter control element, arranged on the sliding member and spring-loaded against the control element, for axially moving the sliding and turning members in an overload situation to release an axial coupling having one coupling member fixedly connected to the cylinder core and another coupling member arranged on the turning member.

9 Claims, 2 Drawing Sheets

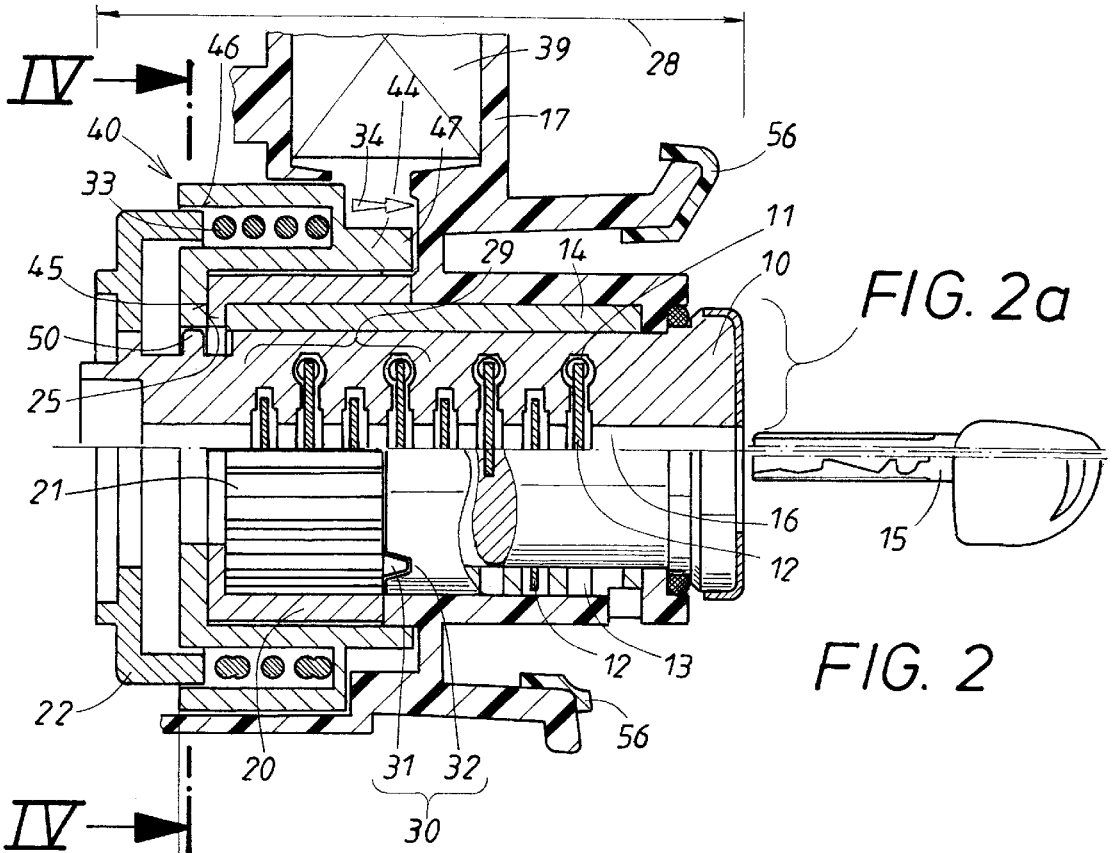
FIG. 2a
FIG. 2
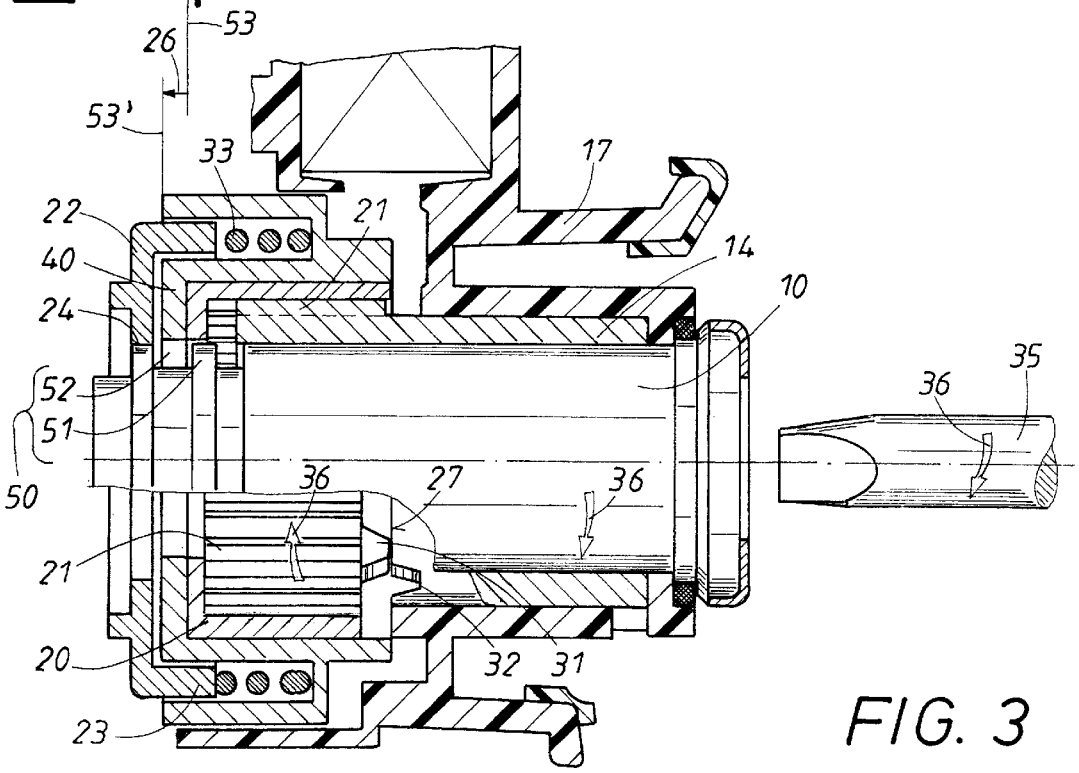
FIG. 3

LOCKING DEVICE WITH A KEY-ACTIVATED CYLINDER CORE

BACKGROUND OF THE INVENTION

1. Field of the Invention

The invention relates to a locking device, in particular, in a motor vehicle, with a key-activated cylinder core which performs locking functions upon rotation. For a rotational support of the cylinder core a cylinder guide is provided having stopping points for tumblers positioned within the cylinder core. In order to make the locking device theft-proof, an overload protection device is provided which is comprised of, on the one hand, an axially fixed profiled control element and a profiled counter control element that is axially movable and spring-loaded against the profiled control element. An overload situation occurs when, without key, a forced rotation is exerted on the cylinder core. In this case, the profiled counter control element is axially lifted off the profiled control element and decouples a turning member relative to the cylinder core, and the cylinder guide is freely rotatable relative to the cylinder core because the cylinder core is fixedly connected thereto by the tumblers. The turning member is now inactive, while normally, upon actuation by the key, it performs the desired locking function, for example, in a lock.

2. Description of the Related Art

In a known locking device of this kind (DE 41 22 414 C1) the profiled control element and the profiled counter control element of the overload securing device are arranged between the housing and the overload protection device while the coupling is realized between the turning member and the cylinder core. The cylinder guide is axially spring-loaded relative to the housing. Between the housing and the cylinder guide a large annular space for a coil spring which surrounds a portion of the cylinder guide must be arranged. Mounting of these components is cumbersome and time-consuming. The transition of the normal situation into the overload situation results in an axial movement of the cylinder guide together with the cylinder core supported therein because the profiled control element of the overload protection device is lifted off the profiled counter control element. This is disruptive. This disruptive axial movement from the normal situation into the overload situation can be oriented axially outwardly (compare FIGS. 1 through 9) or axially inwardly (compare FIG. 10).

There are also locking devices of the aforementioned kind (DE 44 10 783 C1) in which the cylinder guide is not spring-loaded and, together with the cylinder core supported therein, always has an axially fixed position within the housing. In the transition between the key-activated normal situation into the overload situation resulting from the use of a burglary tool, the cylinder core therefore does not perform a disruptive axial movement. Moreover, radial space is also saved in this context because there is no pressure spring acting on the cylinder guide.

The disadvantage of this device is however the large axial construction length. The profiled control element and the profiled counter control element of the overload protection device are arranged between the inner end face of the cylinder guide and a pressure ring which is longitudinally slidable but rotationally fixedly connected to the turning member performing the locking function.

SUMMARY OF THE INVENTION

The invention has the object to develop a locking device of the aforementioned kind in which the cylinder guide and the cylinder core are axially fixedly received in the housing and freely rotatable in the overload situation, but characterized by a minimal axial construction length.

In accordance with the present invention, this object is solved in that:

for rotationally supporting the cylinder core a cylinder guide is provided which has stopping points for tumblers located in the cylinder core;

the cylinder guide is received axially fixed but rotatably in a housing that supports the cylinder guide in the area facing the key, while the other area of the cylinder guide is surrounded by a sliding member fixed against rotation relative to the cylinder guide but axially slidably supported thereon, wherein the sliding member is surrounded by a turning member that is rotatable relative to the sliding member and synchronously axially movable with it;

a spring supported on the housing acts axially on the turning member and thus onto the sliding member synchronously movable with the turning member;

an overload protection device has a profiled control element arranged on the housing and a profiled counter control element, arranged on the sliding member and spring-loaded against the profiled control element, for axially moving the sliding member and the turning member synchronously movable therewith in the overload situation in order to release an axial coupling whose one coupling member is non-rotatingly fixedly connected to the cylinder core and whose other coupling member is arranged on the turning member.

The housing supports only an area of the cylinder guide facing the key while the other area of the cylinder guide is surrounded by a sliding member which is secured against rotation relative to the cylinder guide but is axially slidable thereon. The sliding member is surrounded by the turning member that transmits the locking functions and is rotatable relative to the sliding member and axially synchronously movable with it. The spring serving as overload protection acts axially onto the turning member and thus onto the sliding member which is movable synchronously with the turning member. The profiled elements of the overload protection device are arranged between the sliding member, on the one hand, and the housing provided for supporting the cylinder guide, on the other hand. According to the invention, the profiled elements of the overload protection device can be arranged easily in that axial portion of the cylinder core where the cylinder core has the tumblers and the cylinder guide the stopping points for the tumblers. This results in a reduction of the axial construction length relative to the latter prior art.

BRIEF DESCRIPTION OF THE DRAWINGS

Further measures and advantages of the invention result from the dependent claims, the following description, and the drawings. One embodiment of the invention is represented in the drawings. It is shown in:

FIG. 2 schematically an axial section along section line II—II of FIG. 1 with the components in their rest position and initial rotational position, wherein the cylinder core as well as the cylinder guide are shown in the lower half section with the inner end broken away in order to allow viewing of the inner surfaces of the components radially surrounding it, i.e., a cylinder housing and a sliding member; and in the upper half section in the representation of FIG. 2*a* a sectional view perpendicular thereto along the section line IIa—IIa of FIG. 1 through a cylinder core and a cylinder guide;

FIG. 3 in a representation analog to FIGS. 2 and 2*a*, an axial section of the device along the section lines II—II and IIa—IIa of FIG. 1, of an overload situation wherein by means of a burglary tool the forced rotation of the components is carried out.

DESCRIPTION OF PREFERRED EMBODIMENTS

Figure 1:
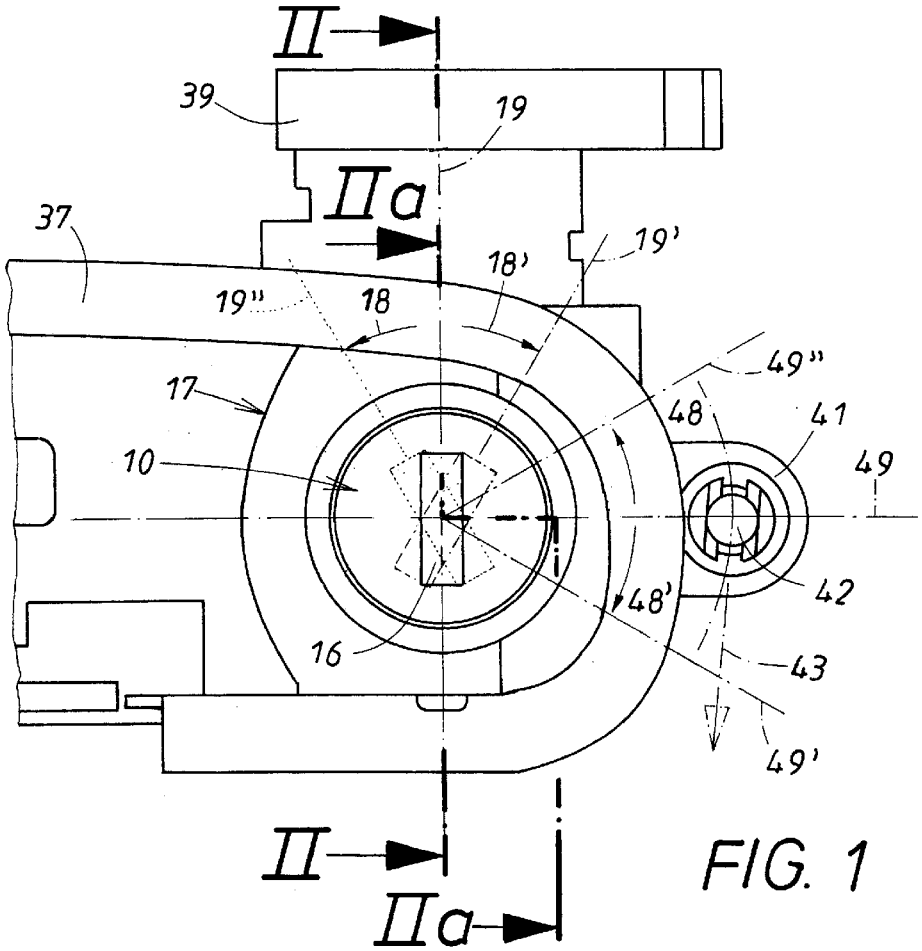
FIG. 1 a plan view onto the locking device before its mounting in the door of a motor vehicle.

The locking device comprises a cylinder core 10 with tumblers 12 force-loaded by springs 11 and received radially movably in the cylinder core 10 so as to engage normally with their ends stopping points 13 of a cylinder guide 14. The stopping points 13 of neighboring tumblers 12 in the present case are separated from one another by stays in the cylinder guide 14 which increases stability. A key 15 with matched key profile is correlated with the cylinder core 10 which, when inserted, sorts the projecting ends of the tumblers 12 in the key channel 16 of the cylinder core 10 with respect to the core cross-section and thus releases the cylinder core 10 relative to the cylinder guide 14 for rotation.

The cylinder guide 14 serves normally as a rotational support for the cylinder core 10.

The cylinder guide 14 is axially fixedly but rotatably received in the housing 17 which is fastened stationarily within the interior of the motor vehicle door. By means of an overload protection device 30, to be explained in more detail in the following, the cylinder guide 14 is usually non-rotatably indirectly secured in the housing 17 by a sliding member, here in the form of a sleeve 20. Between the inner surface of the sliding sleeve 20 and the circumferential surface of the cylinder guide 14 radial toothings 21, complementary relative to one another, are provided which generate an axial guiding of the sliding sleeve 20 on the cylinder guide 14 as well as a rotationally fixed connection between the cylinder guide 14 and the sliding sleeve 20. This not only holds true for the normal situation of the locking device, shown in FIG. 2, but also for the overload situation represented in FIG. 3 and to be explained in more detail in the following.

In the normal situation, according to FIG. 2, the cylinder core 10 is secured by an impulse spring in the initial rotational position indicated by the auxiliary line 19 in FIG. 1. By means of the key 15 inserted into the key channel 16, the cylinder core 10 can now be moved into the rotational working positions indicated by auxiliary lines 19' and 19" and corresponding to a secured and an unsecured position of the locking device. The rotations of the cylinder core 10 illustrated by the arrows of rotation 18, 18' of FIG. 1 namely effect in this normal situation analog rotations 48 and 48' of a working arm 41 belonging to the turning member 40. This working arm 41 is normally positioned in the initial rotational position indicated by the auxiliary line 49 in FIG. 1 which is transformed into the rotational positions illustrated by corresponding auxiliary lines 49', 49" in the direction of the rotational arrows 48, 48'. As illustrated in FIG. 1, a working rod is connected to a pivot joint 42 of the working arm 41 and extends in the direction of the dash-dot arrow 43; it is the first member of a lock, not represented in detail. The rotational positions 49', 49" correspond to a secured or unsecured position of the locking device. In the secured position the actuation of a handle on the motor vehicle door is successful, but in the unsecured position the actuation of the handle has no effect. In the portion of the housing 17 referenced by 39, control means for a so-called "central locking device" of a motor vehicle are provided by which locking devices on different doors of the motor vehicle cooperate.

As can be seen in FIG. 2, the turning member 40 has a cylinder portion 44 which is rotatably supported on the sliding sleeve 20. The sliding sleeve 20 has an axial inner shoulder 25 at its inner end, and on its outer side an axial counter shoulder 45 provided at the turning member 40 is supported. At this location the transmission of the axial spring load illustrated by the force arrow 34 in FIG. 2 between the turning member 40 and the sliding sleeve 20 takes place. This spring load 34 is the result of a rotation and pressure spring 33 which is arranged in an axial receptacle 46 in the turning member 40. The outer end 47 of the turning member 40 facing the housing 17 remains without support.

Figure 4:
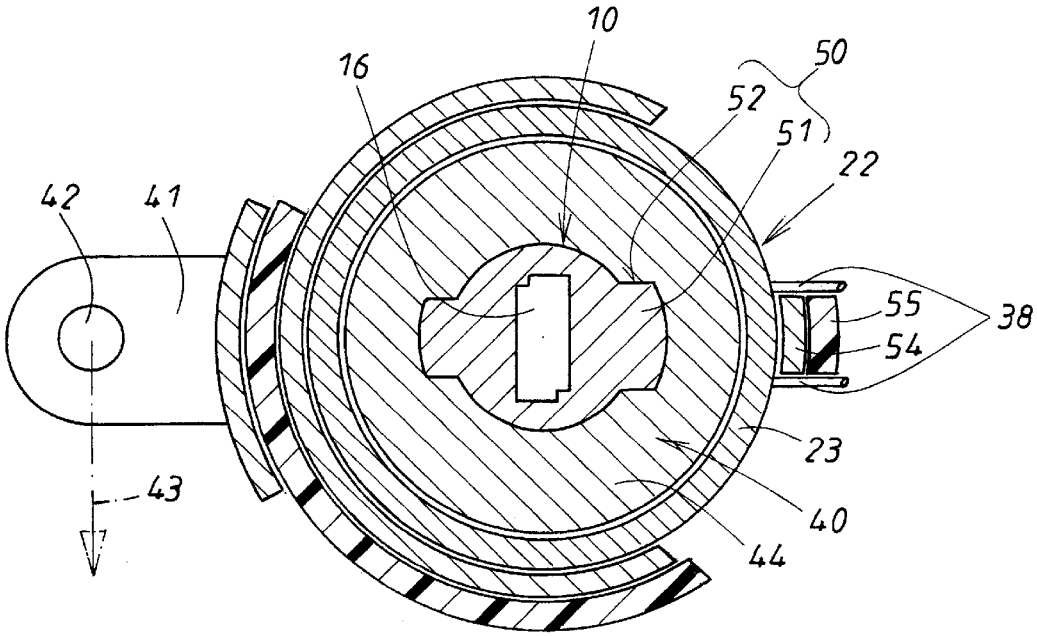
FIG. 4 a cross-section of the device along the section line IV—IV of FIG. 2.

The axial coupling between the turning member 40 and the cylinder core 10, respectively, its axial extension is realized by two coupling members 51, 52 of a coupling 50 which in the normal situation engage one another. In the represented embodiment, as illustrated in FIG. 4, one of the coupling members is comprised of diametrically radially extending projections 51 on the cylinder core 10 and the other coupling member is comprised of corresponding recesses 52 on an inner flange of the cylinder portion 44. The spring 33 secures the turning member 40 usually in the coupled position according to FIGS. 2 and 4. The spring load is supported namely by the aforementioned counter shoulder 45 and the inner shoulder 25 on the sliding sleeve 20 which, in turn, rests against an inner surface of the housing 17 or, via an inner flange provided in the area of the inner shoulder 25, against the inner end face of the cylinder guide 14. This results in the effective initial coupling position 53, illustrated by the auxiliary line 53 in FIG. 2, of the turning member 40 relative to the cylinder core 10. The aforementioned rotations 18, 18' of the cylinder core 10 cause analog rotations 48, 48' of the working arm 41 of the turning member 40.

The spring 33 is supported with its inner end on an end disc 22 which engages with a cylindrical projection 23, illustrated in the sectional view of FIG. 4, the aforementioned axial receptacle 46 of the turning member 40. The end disc 22 is axially fixedly positioned relative to the cylinder core 10, respectively, the stationary housing 17. In the present case a fixed connection 24, illustrated in FIG. 3, is provided between the end disc 22 and the inner end of the cylinder core 10.

In the embodiment the axial spring load 34 also serves to maintain engagement of the overload protection device 30 in the normal situation, according to FIG. 2. The overload protection device is comprised of two profiled elements 31, 32 which cooperate in a control-effecting manner with one another. They are comprised of an axially fixedly positioned profiled control element 32, that is a component of the housing 17 and in the present case is comprised of a recess 32 delimited by two slanted surfaces in the inner wall of the housing 17. The movable profiled counter control element is positioned at the outer end face of the sliding sleeve 20 and is comprised of a cam 31 with correspondingly slanted flanks. It is understood that the profiled elements cooperating in pairs with one another, i.e., a radial projection 31 and a recess 32, can be arranged in multiples over the circumference of the sliding sleeve; for example, two pairs in a diametric position relative to one another.

In the normal situation of FIG. 2, as mentioned above, the engagement position of the cam 31 in the recess 32 is present so that the sliding sleeve 20 is non-rotatable. Moreover, the sliding sleeve 20 is secured by profiled elements 31, 32 of the overload protection device in a certain rotational position. By means of the aforementioned radial toothings 21 this results in a corresponding rotational position of the cylinder guide 14. Thereby, the aforementioned initial rotational position 19 of the cylinder core 10 is determined via the tumblers 12 falling into the stopping points 13 of the cylinder guide 14.

In FIG. 3, as already mentioned, the overload situation of the device is shown. Burglary tool 35 engaging the cylinder core 10 has caused a forced rotation 36 of the cylinder core 10. In this case the tumblers 12 are in locking engagement at the cylinder guide 14, as illustrated in the lower half section of FIG. 2. Upon forced rotation 36 the cylinder guide 14 is thus entrained by the cylinder core 10. Between the slanted flanks of the two profiled elements 31, 32 a force acting axially against the spring load 34 results which lifts the cam(s) 31 of the stationary recess(es) 32. The cam tip of the cam 31 comes to rest against an inner end face 27 on which it will glide upon further forced rotation 36. Accordingly, the sliding sleeve 20 has been moved inwardly according to the profile height of 31, 32 by a travel stroke corresponding to the axial movement arrow 26 in FIG. 3. Via the inner shoulder 25 of the sliding sleeve 20 and the counter shoulder 45 the turning member 40 has also been entrained by this travel stroke 26 and is positioned in the axially displaced "push position" illustrated by auxiliary line 53' in FIG. 3. This has two effects.

As can be seen in FIG. 3, the turning member 40 with its afore described coupling member 52 is disengaged relative to the counter coupling member 51 of the cylinder core 10. The forced rotation 36 of the cylinder core 10 can thus not be transmitted onto the turning member 40. Via the toothings 21 the sliding sleeve 20 will rotate because of the forced rotation 36 of the cylinder guide 41; however, this has no effect on the turning member 40. The turning member 40 is only axially displaced by the travel stroke 26. Its working arm 41 remains in the initial rotational position illustrated in FIG. 1. An actuation of the working rod 43 extending to the lock thus is not taking place upon forced rotation 36.

Moreover, manipulations for rotation 48 or 48' of the working arm 41 of the turning member 40 in other ways is prevented by rotational blocking. In the push position 53' the turning member 40 is aligned with surfaces at the housing, not illustrated in more detail, which prevent an adjustment of the working arm 41 by manipulations.

The inventive device is characterized by a surprisingly small axial construction length 28. Such a minimal axial dimension is very favorable for the arrangement of the device in the interior of a vehicle door. This minimal axial size is firstly the result of the sliding sleeve 20 being positioned with substantial radial overlap on the cylinder guide 14 and thus in the axial section of the locking cylinder indicated by 29 in FIG. 2 where the last tumblers 12 are located. The sliding sleeve 20 is thus positioned in this inner control portion 29 between cylinder core 10 and cylinder guide 14. However, the turning member 40 is also positioned in this control portion 29. Accordingly, no or minimal axial space for the arrangement of the sliding sleeve 20 and of the turning member 40 is required. The space required for the arrangement of the axial coupling 50 is sufficient.

As shown in FIG. 1, the housing 17 can be a component of a bracket-shaped arrangement 37. Supports 56, illustrated in FIG. 2, are provided at the housing with which the housing or the bracket 37 can be supported on the inner surface of the door panel.

The afore described spring 33 can have spring legs 38, as illustrated in FIG. 4, between which, on the one hand, a segment 54 of the turning member 40 and, on the other hand, a stationary segment 55 of the housing 17 are positioned. Accordingly, the afore described initial rotational position 49 of the turning member 40 of FIG. 1 is ensured. When the key 15 in the normal situation is released after rotation 18 or 18' of FIG. 1, the spring 33 returns the turning member 40 by means of the spring legs 38. Via the aforementioned coupling 50 this return movement results in a corresponding automatic return of the cylinder core 10 into its initial rotational position 19 of FIG. 1.

What is claimed is:

1. Locking device with a key-actuated cylinder core (10) which performs by rotation (18, 18') locking functions, with the following further features:

for rotationally supporting the cylinder core (10) a cylinder guide (14) is provided which has stopping points (13) for tumblers (12) located in the cylinder core (10);

the cylinder guide (14) is received axially fixed but rotatably in a housing (17) that supports the cylinder guide (14) in the area facing the key, while the other area of the cylinder guide (14) is surrounded by a sliding member (20) fixed against rotation relative to the cylinder guide (14) but axially slidably supported thereon, wherein the sliding member (20) is surrounded by a turning member (40) that is rotatable relative to the sliding member (20) and synchronously axially movable with the sliding member (20);

a spring (33) supported on the housing acts axially on the turning member (40) and thus onto the sliding member (20) synchronously movable with the turning member (40);

an overload protection device (30) has a profiled control element (32) arranged on the housing (17) and a profiled counter control element (31), arranged on the sliding member (20) and spring-loaded against the profiled control element (32), for axially moving the sliding member (20) and the turning member (40) synchronously movable therewith in an overload situation in order to release an axial coupling (50) whose one coupling member (51) is non-rotatingly fixedly connected to the cylinder core (10) and whose other coupling member (52) is arranged on the turning member (40).

2. Device according to claim 1, wherein in the overload situation the turning member (40) is axially moved (26) by the sliding member (20) from its initial position (53) into a push position (53'), in which the turning member (40) is blocked with respect to rotation on surfaces provided on the housing.

3. Device according to claim 1, wherein the turning member (40) is arranged with at least one axial partial length radially outside of the sliding member (20).

4. Device according to claim 3, wherein the turning member (40) has a cylinder portion (44) which is rotatably supported on the sliding member (20).

5. Device according to claim 1, characterized in that the sliding member is embodied as a sliding sleeve 20 which surrounds the cylinder guide (14) annularly.

6. Device according to claim 5, wherein between the circumferential surface of the cylinder guide (14), on the one hand, and the inner surface of the sliding sleeve (20), on the other hand, radial toothings (21) complementary to one another are provided which provide an axial guiding and a non-rotating fixed connection of the sliding sleeve (20) on the cylinder guide (14).

7. Device according to claim 1, characterized in that the sliding member (20) and/or the turning member (40) are arranged at least with portions thereof in that partial piece (29) of the cylinder core (10) where the tumblers (12) are located.

8. Device according to claim 5, wherein the turning member (40) axially loaded by the spring load (34) has an axial inner shoulder (45) at its inner end which is supported on the inner end (25) of the sliding member (20), but that the outer end (47) of the turning member (40) which faces the housing (17) is not supported.

9. Device according to claim 1, wherein the turning member (40) has an axial recess (46) for a rotation and pressure spring (33) which generates the axial spring load (34) of the overload protection device (30) as well as a rotational return force for the turning member (40) and that the spring (33) is supported, on the one hand, on the turning member (40) and, on the other hand, on an end disk (22), and that the end disk (22) is axially fixedly arranged relative to the cylinder core (10), respectively, the housing (17).

* * * * *